US009702520B2

(12) United States Patent
Lin

(10) Patent No.: US 9,702,520 B2
(45) Date of Patent: Jul. 11, 2017

(54) AUTOMOTIVE DAYTIME RUNNING LIGHTS

(71) Applicant: ScienBiziP Consulting (Shenzhen) Co., Ltd., Shenzhen (CN)

(72) Inventor: Chen-Han Lin, New Taipei (TW)

(73) Assignee: ScienBiziP Consulting(Shenzhen)Co.,Ltd., Shenzhen (CN)

( * ) Notice: Subject to any disclaimer, the term of this patent is extended or adjusted under 35 U.S.C. 154(b) by 127 days.

(21) Appl. No.: 14/587,202

(22) Filed: Dec. 31, 2014

(65) Prior Publication Data

US 2016/0091163 A1 Mar. 31, 2016

(30) Foreign Application Priority Data

Sep. 25, 2014 (TW) ..... 103133181 A

(51) Int. Cl.

| | |
|---|---|
| ***F21V 11/00*** | (2015.01) |
| ***F21S 8/10*** | (2006.01) |
| *F21Y 101/00* | (2016.01) |
| *F21Y 115/30* | (2016.01) |
| *F21Y 115/10* | (2016.01) |

(52) U.S. Cl.

CPC ..... *F21S 48/234* (2013.01); *F21S 48/214* (2013.01); *F21S 48/2212* (2013.01); *F21S 48/24* (2013.01); *F21S 48/1757* (2013.01); *F21Y 2101/00* (2013.01); *F21Y 2115/10* (2016.08); *F21Y 2115/30* (2016.08)

(58) Field of Classification Search

CPC ..... F21S 48/1778; F21S 48/1352; F21S 48/1388; F21S 48/1757; F21S 48/1784

USPC ..... 362/510

See application file for complete search history.

(56) References Cited

U.S. PATENT DOCUMENTS

2009/0257240 A1* 10/2009 Koike ..... F21S 48/1159 362/538

2015/0338044 A1* 11/2015 Singer ..... F21V 7/22 362/510

* cited by examiner

*Primary Examiner* — Anh Mai

*Assistant Examiner* — Matthew Peerce

(74) *Attorney, Agent, or Firm* — Steven Reiss

(57) ABSTRACT

Automotive daytime running lights, includes a light source and reflecting plates arranged on a light path of the light source. A substrate is arranged near the reflecting plates. A plurality of reflecting cups is formed on a surface of the substrate. Every reflecting plate faces a corresponding reflecting cup. The reflecting plates can rotate around light source to change the light exiting from the light source. The invention uses a laser source with reflecting plates to make the automotive daytime running lights have high visibility and be aesthetic in appearance.

16 Claims, 1 Drawing Sheet

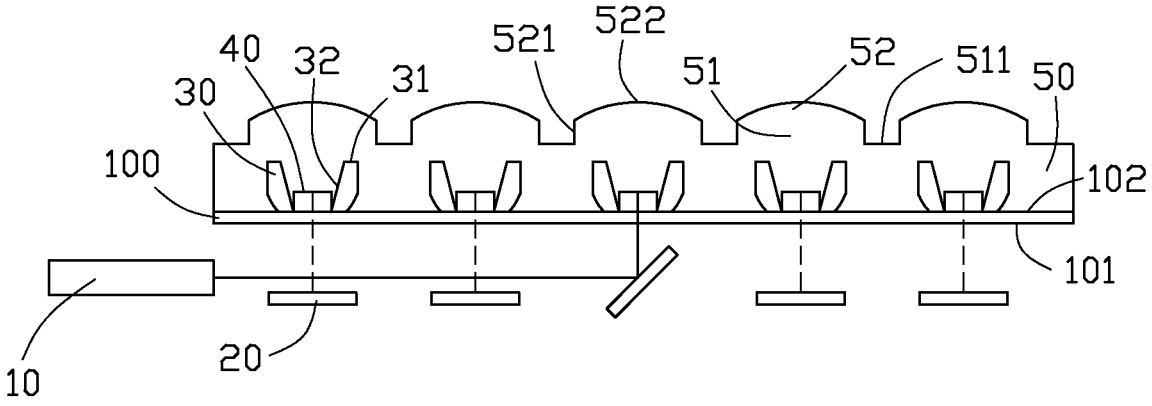
40
32
31
521
522
51
52
511
50
30
100
102
101
10
20

AUTOMOTIVE DAYTIME RUNNING LIGHTS

CROSS-REFERENCE TO RELATED APPLICATIONS

This application claims priority to Taiwanese Patent Application No. 103133181 filed on Sep. 25, 2014, the contents of which are incorporated by reference herein.

FIELD

The subject matter herein generally relates to an automotive daytime running light.

BACKGROUND

A conventional automotive daytime running light is a warning light to remind people to pay attention to a running vehicle to decrease accidents. The automotive daytime running light is used to arrange a plurality of LED sources in a line and mounts a reflecting cup to adjust the light. However, the automotive daytime running light has limited visibility.

BRIEF DESCRIPTION OF THE DRAWINGS

Implementations of the present technology will now be described, by way of example only, with reference to the attached figures.

The FIGURE is a cross sectional view of an automotive daytime running light of the present disclosure.

DETAILED DESCRIPTION OF EMBODIMENTS

It will be appreciated that for simplicity and clarity of illustration, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure. The description is not to be considered as limiting the scope of the embodiments described herein.

A definition that applies throughout this disclosure will now be presented. The term "comprising" means "including, but not necessarily limited to"; it specifically indicates open-ended inclusion or membership in a so-described combination, group, series and the like.

Referring to FIG. 1, an automotive daytime running light includes a light source 10, a plurality of reflecting plates 20 arranged on a light path of the light source 10, a substrate 100 paralleled the road of the light path of the light source 10, a plurality of reflecting cup 30 located above the reflecting plates 20 and a lamp shell 50 located on the substrate 100.

In at least one embodiment, the light source 10 is a blue laser light source.

The reflecting plates 20 are spaced each other and arranged on the light path of the light source 10. In at least one embodiment, the reflecting plates 20 are total reflection mirrors. Every reflecting plate 20 faces to a corresponding reflecting cup 30. The reflecting plates 20 are rotatable adjusted by a controller (not shown). The controller may be a motor or an electrical components etc. The reflecting plate 20 may be asynchronized. At the same time, only one reflecting plate 20 reflects light of the light source 10. The controller controls a frequency of the rotation of the reflecting plates 20 to adjust the light efficiency. If the reflecting plates 20 rotate in a higher frequency, a light with a consistent intensity may be visible for people. If the reflecting plates 20 rotate in a lower frequency, a light with a variational intensity may be visible for people.

The substrate 100 is made of transparent thermal conductive material and located at top of the reflecting plates 20. In this disclosure, the substrate 100 is located above the light path of the light source 10 and parallel to the light path of the light source 10. The substrate 100 includes a first surface 101 and a second surface 102 opposite to the first surface 101. The first surface 101 is spaced from the reflecting plate 20. The plurality of reflecting cups 30 and the lamp shell 50 are mounted on the second surface 102.

The plurality of reflecting cups 30 faces to the reflecting plates 20. Each of the reflecting cups 30 includes a top surface 31 and an inner surface 32 extending from the top surface 31. The inner surface 32 defines a hole therebetween. The diameter of the hole of the reflecting cup 30 is gradually decreasing from the top surface 31 to a bottom of the reflecting cup 30. The bottom of the hole is filled with a phosphor layer 40.

The lamp shell 50 is mounted on the second surface 102 and spaced from and covers the reflecting cup 30. The lamp shell 50 includes a main portion 51 and a plurality of extending portions 52. The main portion 51 includes a top surface 511. The plurality of extending portions 52 is located above the top surface 511 of the main portion 51. The main portion 51 extends from the second surface 102. The cross section of the main portion 51 is a rectangular. Each of the extending portions 52 includes a connecting portion 521 protruding from the main portion 51 and a top portion 522 protruding from the center of the connecting portion 521. Every extending portion 52 faces to a corresponding reflecting cup 30. The width of the extending portion 52 is equal to or larger than that of the reflecting cup 30, and each of the extending portions 52 is located above the reflecting cup 30. The center of the top portion 522 is convex. The extending portions 52 have a function of the convex lens to gather the light.

In the present disclosure, the light from the light source 10 is reflected by the reflecting plates 20 and the reflecting cup 30 in series and then gathered by the lamp shell 50. The reflecting plates 20 can rotate fast or slowly. So the frequency of the rotation can be controlled to adjust the light efficiency by the controller.

It is to be further understood that even though numerous characteristics and advantages have been set forth in the foregoing description of embodiments, together with details of the structures and functions of the embodiments, the disclosure is illustrative only; and that changes may be made in the details, including in matters of shape, size, and arrangement of parts within the principles of the disclosure to the full extent indicated by the broad general meaning of the terms in which the appended claims are expressed.

The embodiments shown and described above are only examples. Many details are often found in the art such as the other features of an automotive daytime running light. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An automotive daytime running light comprising:

a light source;

a plurality of reflecting plates arranged along a light path of the light source;

a substrate located above the plurality of reflecting plates; and a plurality of reflecting cups formed on the substrate;

wherein the substrate includes a first surface and a second surface, each reflecting plate faces a corresponding reflecting cup, and the reflecting plates are able to rotate around the light source to change the light path of the light exiting from the light source;

wherein a lamp shell is mounted on the second surface of the substrate, the lamp shell being spaced apart from and covering the reflecting cups;

wherein the lamp shell includes a main portion and a plurality of extending portions located above a top surface of the main portion, each extending portion faces a corresponding reflecting cup.

2. The automotive daytime running light of claim 1, wherein the reflecting plates are total reflection mirrors.

3. The automotive daytime running light of claim 1, wherein the reflecting plates are spaced apart from each other.

4. The automotive daytime running light of claim 1, wherein the reflecting cup includes a top surface and an inner surface extending from the top surface.

5. The automotive daytime running light of claim 4, wherein a hole is defined in the inner surface.

6. The automotive daytime running light of claim 5, wherein the diameter of the hole decreases along a direction from the top surface to the bottom of the reflecting cup.

7. The automotive daytime running light of claim 5, wherein portions of the inner surface define a bottom of the hole, and the bottom of the hole has a phosphor layer.

8. The automotive daytime running light of claim 1, wherein the extending portions correspond to the reflecting plates.

9. The automotive daytime running light of claim 1, wherein the main portion extends from the second surface of the substrate, and the cross section of the main portion is rectangular.

10. The automotive daytime running light of claim 1, wherein the extending portions includes a connecting portion protruding from the main portion and a top portion protruding from the connecting portion.

11. The automotive daytime running light of claim 10, wherein each of the extending portions are located above the reflecting cup and the width of each of the extending portions is equal to or larger than the width of the reflecting cup.

12. An automotive daytime running light comprising:

a light source;

a plurality of reflecting plates arranged along a light path of the light source;

a substrate located above the plurality of reflecting plates;

a plurality of reflecting cups formed on the substrate; and a lamp shell mounted on a second surface and spaced from and covering the reflecting cups;

wherein the lamp shell included a main portion and a plurality of extending portion located above a top surface of the main portion;

wherein each extending portion faces a corresponding reflecting cup.

13. The automotive daytime running light of claim 12, wherein the extending portions correspond to the reflecting plates.

14. The automotive daytime running light of claim 12, wherein the main portion extends from the second surface of the substrate, and the cross section of the main portion is rectangular.

15. The automotive daytime running light of claim 12, wherein the extending portions include a connecting portion protruding from the main portion and a top portion protruding from the connecting portion.

16. The automotive daytime running light of claim 15, wherein each of the extending portions are located above the reflecting cup and the width of each of the extending portions is equal to or larger than the width of the reflecting cup.

* * * * *